US005593348A

United States Patent [19]

Rickert

[11] Patent Number: 5,593,348

[45] Date of Patent: Jan. 14, 1997

[54] VENTILATING ELEMENT FOR ROOFS

[75] Inventor: Hubert Rickert, Nagold-Emmingen, Germany

[73] Assignee: Norm A.M.C. AG, Switzerland

[21] Appl. No.: 372,912

[22] Filed: Jan. 17, 1995

[30] Foreign Application Priority Data

Jan. 17, 1994 [DE] Germany ..... 44 01 139.3

[51] Int. Cl.[6] ..... F24F 7/02

[52] U.S. Cl. ..... 454/365; 52/57; 52/199

[58] Field of Search ..... 454/365; 52/57, 52/199

[56] References Cited

U.S. PATENT DOCUMENTS 5,332,393 7/1994 Gödl ..... 454/365

FOREIGN PATENT DOCUMENTS 0273991 11/1986 European Pat. Off. .
8913744 11/1989 Germany .

*Primary Examiner*—Harold Joyce
*Attorney, Agent, or Firm*—Sixbey, Friedman, Leedom & Ferguson, P.C.; David S. Safran

[57] ABSTRACT

A ventilating element with a ventilator cap for mounting on the ridge, hip or arris area of a roof, and which has at least one elastically flexible sealing member that extends along a longitudinal edge area of the cap. The sealing member is formed as a looped filament seal. This configuration has the advantage that undesirable de-orientations of the filaments are prevented. This is because the loop structure has no free filament ends, and there is always a curvature in the end region which, on the one hand, prevents unintentional back-hooking, and on the other hand, imparts a certain coupling effect to adjacent loops, so that overall interlinking and interlacing of the individual loops are present, benefitting each other, especially by holding one another down, and preserving a close, flow-tight packing. The loop filament seal is formed of filament material having an elasticity which ensures the sealing function is established by placing the individual filaments on top of one another, by overlapping them and so forth.

8 Claims, 12 Drawing Sheets

VENTILATING ELEMENT FOR ROOFS

BACKGROUND OF THE INVENTION

1. Field of the Invention

The invention relates to a ventilating element with a ventilator cap for mounting on the ridge, hip or arris area of a roof, and which has at least one elastically flexible sealing member that extends along a longitudinal edge area of the cap.

2. Description of Related Art

Use of foam sealing members in ventilating elements for roofs are known. The disadvantage is that for varied spacing differences and/or sharp-edged transitions the foam, due to its structure, is not able to achieve sufficient tightness. In addition it is also disadvantageous that the foam undergoes an aging process and embrittles as time passes, so that age and functional endurance are not ensured. Finally, foam requires strong compression which makes it difficult to place, also accessible areas are exposed to bird damage and weathering. Cementing the sealing members of foam to the fan cover also entails the risk that the adhesive will detach and the sealing members fall off.

In U.S. Pat. No. 5,332,393, a ventilator cap is disclosed in which a sealing element extending over the length of the cap on an underside thereof is formed of a fine-fiber brush with a carrier part and a plurality of elastic brush fibers in as flowtight a packing as possible. To minimize the effects of UV radiation and considerable temperature changes (which can cause the fibers to become embrittled, lose their resilience and break off easily, thereby reducing the packing density and sealing efficiency of the sealing element), a protective element is provided on an outer side of the sealing element which influences the elasticity of the brush fibers as little as possible. The fibers can be of the same length or can have lengths which produce a stepped or wedge-shaped inside contour. However, here, the disadvantage exists that the free ends of the brush fibers, therefore the individual fiber tips, can bend, for example, when they abut obstacles such as rough spots or edges, by which the sealing integrity is jeopardized. The brush fibers have the property of very easily lining up, by which flow-tight packing is no longer ensured, and moreover this makes a visually poor impression.

SUMMARY OF THE INVENTION

On the basis of the foregoing, it is a principal object of the present invention to devise a ventilating element of the aforementioned type which is simply built, which ensures an optimum seal, and which is homogeneously adapted to any roofing material.

The aforementioned problem is solved according to preferred embodiments of the invention by the sealing member being formed as a looped filament seal. This configuration has the advantage that undesirable de-orientations of the filaments are prevented. This is because the loop structure has no free filament ends, and there is always a curvature in the end region which, on the one hand, prevents unintentional back-hooking, and on the other hand, imparts a certain coupling effect to adjacent loops, so that overall interlinking and interlacing of the individual loops are present, benefitting each other, especially by holding one another down, and preserving a close, flow-tight packing. This ensures optimum integrity. The loop filament seal according to the invention, thus, has a very uniform behavior. There is essentially no compression in the subject matter of the invention, so that the loop filament seal according to the invention is very easy to install and does not heavily load parts mechanically. The loop filament seal consists of filament material having an elasticity which ensures the sealing function is established by placing the individual filaments on top of one another, by overlapping them and so forth.

According to one embodiment of the invention, the loop filament seal has loops in which the front and back filaments do not overlap one another, the front filament of a loop is defined as the portion which runs to the free end of the loop; the back filament is the portion of the loop which runs back from the free end. If there is no overlapping in a loop, it is a so-called "meander" arrangement; this does not mean that adjacent loops do not overlap, which is, of course, the case for reasons of seal integrity. Rather, in a meander arrangement, the filaments of a loop are placed such that the front and back filaments do not overlap or cross one another.

However, it is possible, as an alternative in accordance with the invention, for the loop filament seal to have loops in which the front and back filaments overlap. In this way, a so-called "mesh" loop is formed.

All possibilities of loop formation can, of course, also be implemented in any combination on the ventilator cover, so long as the loop formation always leads to the individual fibers cross linking with one another.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
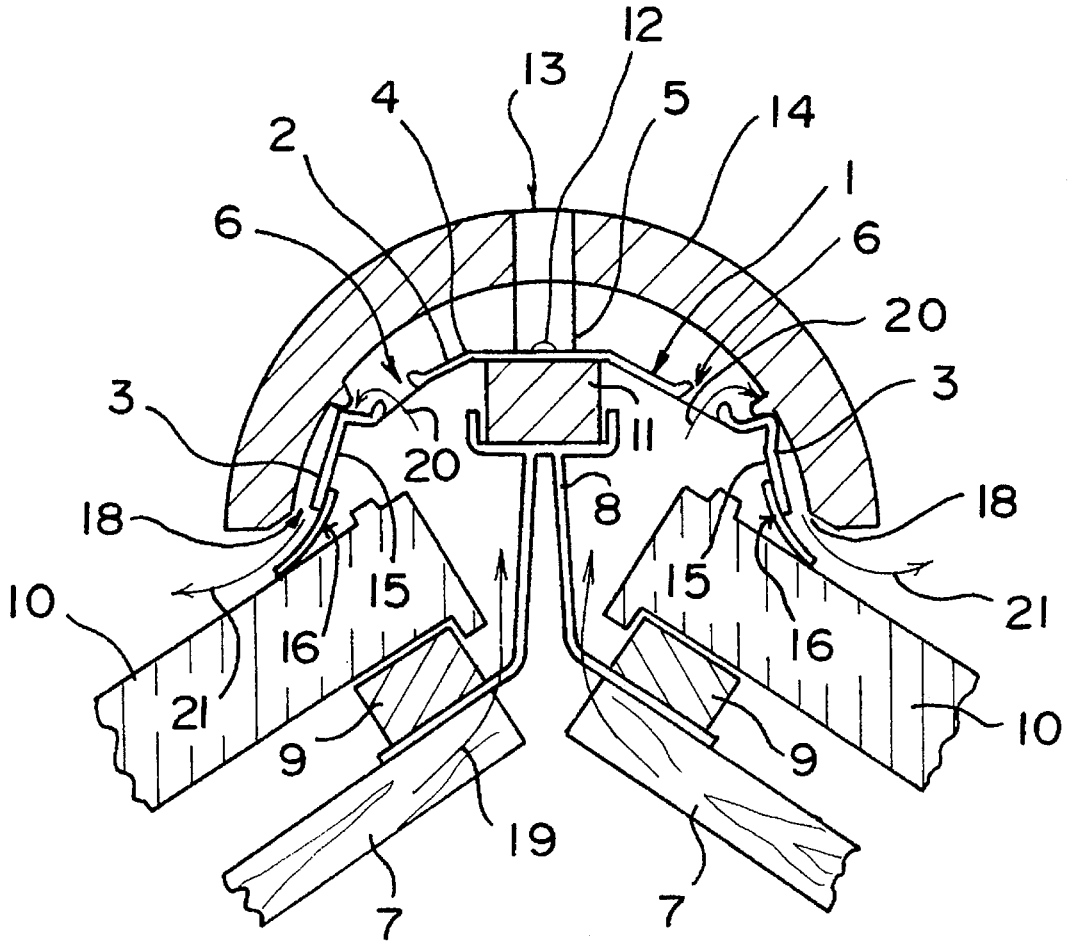
FIG. 1 shows a cross section through a ridge area of the roof of a building with a ventilator element mounted thereon.

FIG. 1 shows a cross section through the roof of a house in the area of the ridge. The invention relates to ventilating element 1 which however can be used not only in the ridge area of the roof, but can also be used in other areas, for example, in the area of the hip or arris. Ventilating element 1 is designed as a one-piece ventilator cover 2 which has side walls 3 and ceiling wall 4 formed therebetween. Ceiling wall 4 is penetrated on both sides of an attachment area 5 by ventilation openings 6.

The ridge area of the roof has angled panels 7 on which a lath holder 8 is attached. In the attachment area of lath holder 8 are laths 9 which are used for hanging and holding roof covering material 10. Lath holder 8 bears ridge joint panel 11 on which ventilator cover 2 is attached by screws 12 in attachment area 5. Screws 12, at the same time, partially attach ridge brace 13 which is used to hold ridge covering 14.

In the area 15 inside of side walls 3 of ventilator cover 2 sealing members 16 are attached. This can be done, for example, by means of a clip connection, a push-in connection, an adhesive connection or a screw connection. Sealing members 16 are used to seal, essentially flow-fight, mostly irregularly sized gaps 18 between the lower end of side walls 3 of ventilator cover 2 and roof covering material 10. To vent the roof, the air can rise in the manner of arrows 19, pass through ventilation openings 6 of ventilator cover 2 (arrows 20) and exit to the outside in the area between ridge covering 14 and the upper side of the respective sealing member 16 (arrows 21).

Each sealing member 16 according to the invention is formed as loop filament seal 22. Each loop filament seal 22 is comprised of a number of loops 23 which consist of filament material 24. Filament material 24 is, preferably, a plastic material.

Each loop 23 consists of a front filament 25 and a back filament 26 which merge with one another in free end area 27 in turning area 28, i.e., a one-piece, arc-shaped loop end 29 is formed on each loop 23 in turning area 28.

Figure 2:
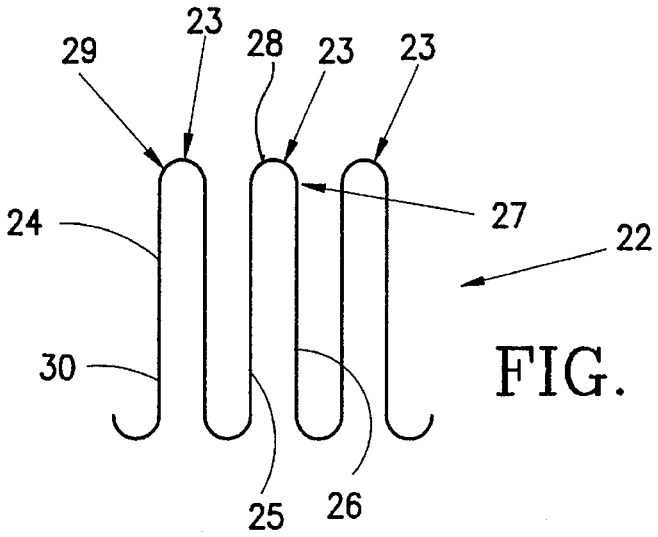
FIG. 2 shows a schematic representation of filament patterning for a sealing member.
Figure 9:
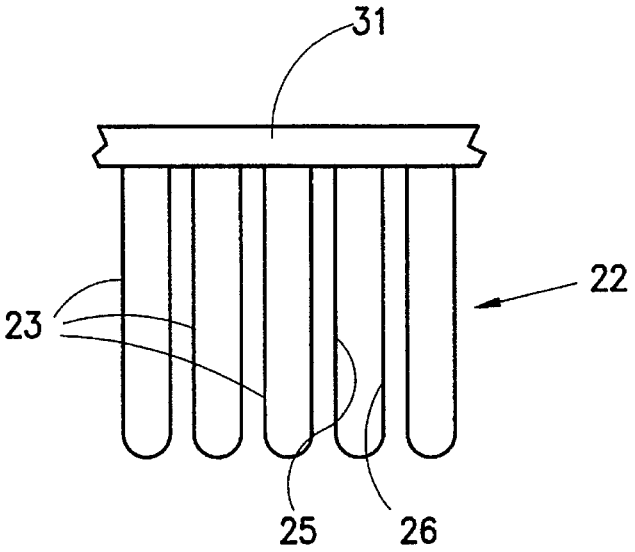
FIG. 9 shows the sealing member of FIG. 3 in the mounted state.

FIG. 2 illustrates that individual loops 23 are formed by means of a meandering continuous filament 30. If they are associated with a holder 31 according to FIG. 3, this is done preferably such that a clamping sheet 32 is placed under this meandering arrangement intermediate the longitudinal extension of loops 23 and a retaining strip, for example wire 33, is placed on the meandering arrangement such that it runs centrally to the clamping sheet 32. If clamping sheet 32 is now folded centrally along its length, wire 33 is pinched and with it the meandering arrangement is folded by an angle of 180°, by which continuous filament 30 is held in the area of clamping sheet 32. Then, the arrangement according to FIG. 9 is formed, i.e., a plurality of loops 23 are held by holder 31, front and back filaments 25, 26 running roughly parallel to one another, i.e., they are held without crossing. Of course, FIG. 9 only schematically illustrates a portion of the loop filament seal 22 formed in this way, since only a few loops 23 are shown. In reality, a plurality of these loops 23 are arranged on top of one another in densely packed form and also in many layers and different lengths so that overall a flow-tight packing is formed.

Figure 4:
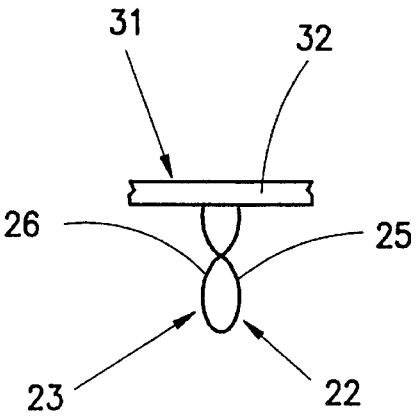
FIG. 4 shows another embodiment of the sealing member in a schematic representation in the mounted state.

FIG. 4 shows one embodiment which corresponds essentially to the embodiment of FIG. 9, however front and back filaments 25, 26 are laid to cross so that a configuration approximating a figure eight results overall.

Figure 5:
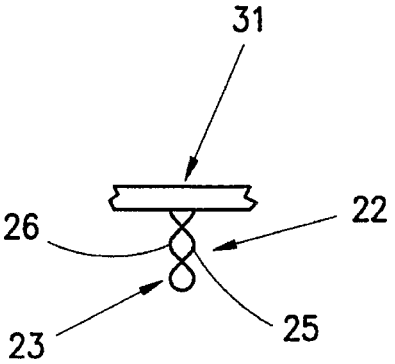
FIG. 5 shows a modified form for an arrangement according to the embodiment shown in FIG. 4 in the mounted state.

The embodiment of FIG. 5 differs from that of FIG. 4 in that the front and back filaments 25, 26 cross twice producing just over a full figure eight for each loop 23.

Figure 3:
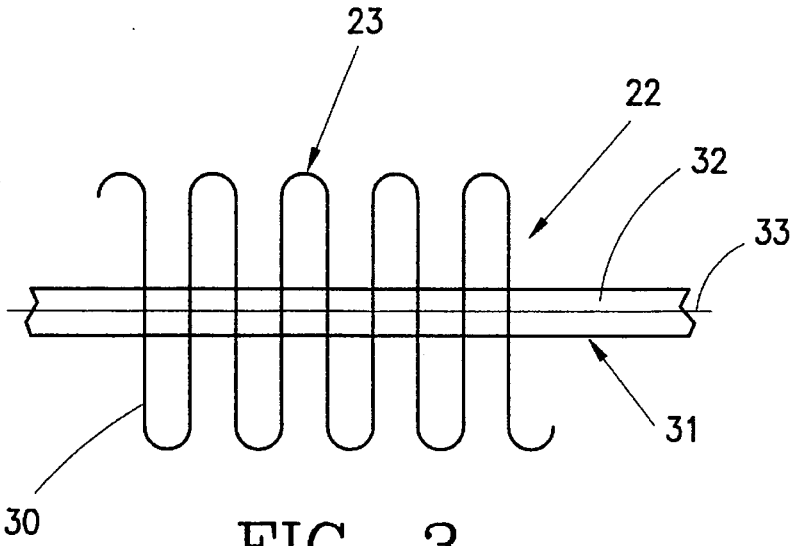
FIG. 3 shows a schematic representation of the holder for the filament member of FIG. 2.
Figure 6:
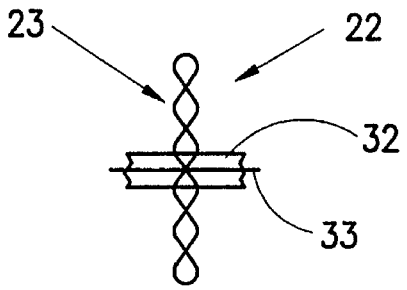
FIG. 6 shows the sealing member of FIG. 5 in an intermediate stage of being mounted.

FIG. 6 illustrates the arrangement of FIG. 5 in which loop 23 is in the intermediate state shown in FIG. 3, and as relative to the embodiment of FIG. 3, it is held by means of clamping sheet 32 and wire 33 and is to be folded over centrally by 180°.

Figure 7:
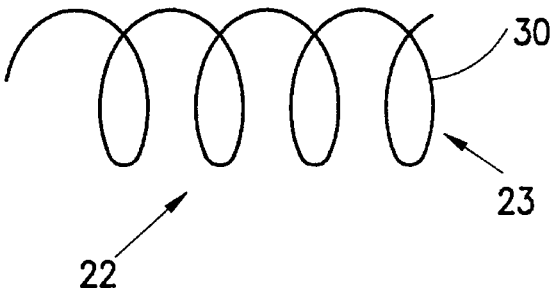
FIG. 7 shows a schematic representation of filament patterning according to another embodiment in an unmounted state.
Figure 8:
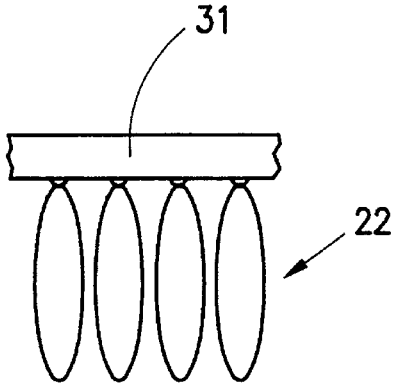
FIG. 8 shows the arrangement of FIG. 7 in the mounted state.

The embodiment of FIG. 7 shows a configuration of loops 23 in the manner of a series of the lower case script letter l. Preferably, to form a configuration of this type continuous filaments 30 are likewise used. They are held according to FIG. 8 by means of holder 31 in the area of their one end.

Figure 10:
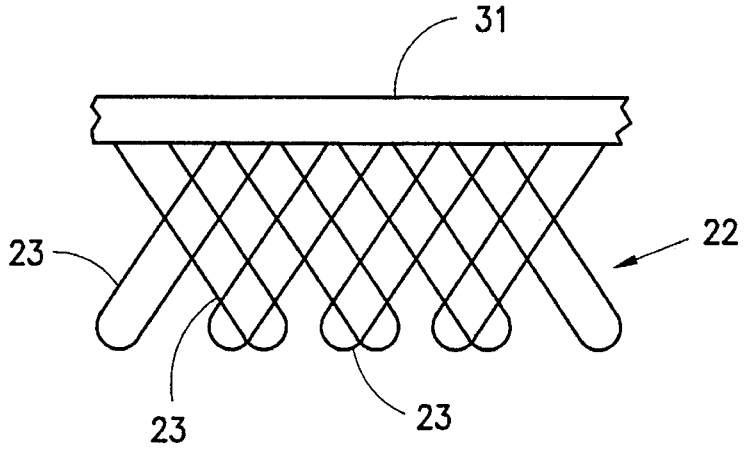
FIG. 10 shows an embodiment of a sealing member having angled loops.

FIG. 10 shows an embodiment in which loops 23 are not aligned in a position which runs essentially perpendicular to the longitudinal extension of holder 31 as is in the preceding embodiments. Instead, individual loops 23 form an acute or obtuse angle with the longitudinal extension of holder 31 in the mounted state and thus, diagonally to the longitudinal extension of ventilator cover 2. Acute and obtuse angles can also be provided alternatingly or in a stochastic distribution, by which the crosslinking effect is intensified. Preferably loops 23 are arranged such that they cross one another, as shown in FIG. 10. Obtaining a high packing density is a general prerequisite for entry and flow sealing and applies to all embodiments from FIG. 1 through FIG. 30.

Figure 11:
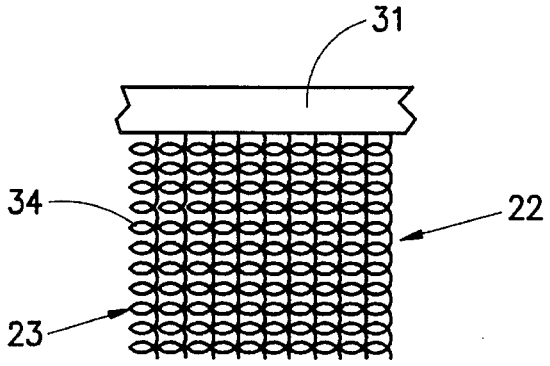
FIG. 11 shows an embodiment of a sealing member having helicoidal or spiral loops.
Figure 12:
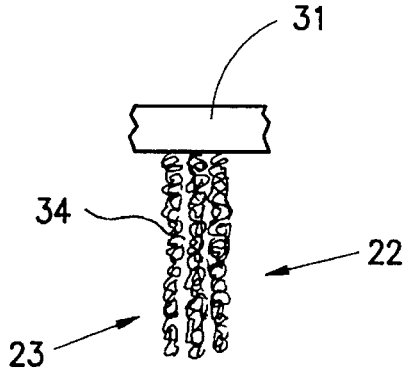
FIG. 12 shows an embodiment of a sealing member having plaited loops.

FIG. 11 shows another embodiment of a loop filament seal 22 in which individual loops 23 are formed by filaments 34 which run helicoidally and spirally. Another embodiment of loop filament seal 22 according to the invention is shown in FIG. 12 in which loops 23 are formed by filaments 34 which run in the manner of a plait or braid.

Figure 13:
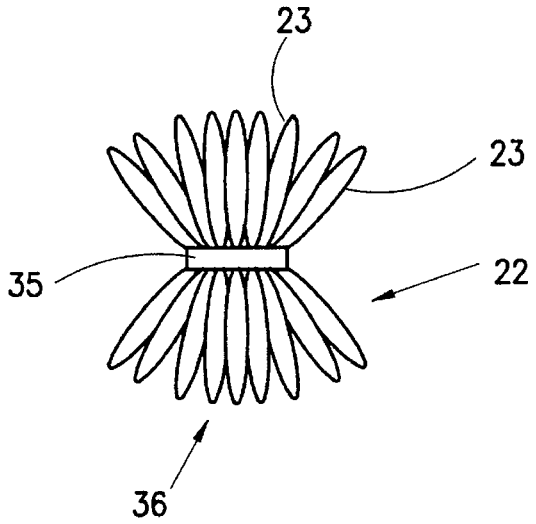
FIG. 13 shows a schematic representation of a sealing member which has bunched loops in an unmounted state.
Figure 14:
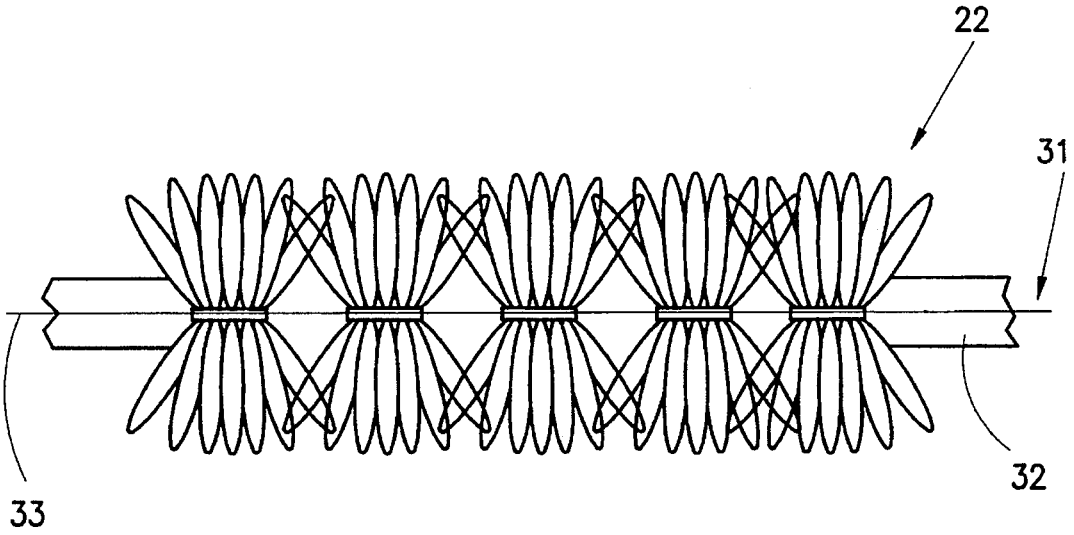
FIG. 14 shows the embodiment of a sealing member according to FIG. 13 in a mounted state.

FIG. 13 shows loops 23 which are held together as bunches 36 by means of a suitable gathering element 35. Individual bunches 36 are held to form an overall loop filament seal by means of holder 31 (FIG. 14) which can be formed, preferably, as a clamping sheet 32 and wire 33 which is then folded as with the prior embodiments to hold the individual bunches 36 in an overlapping arrangement.

Figure 15:
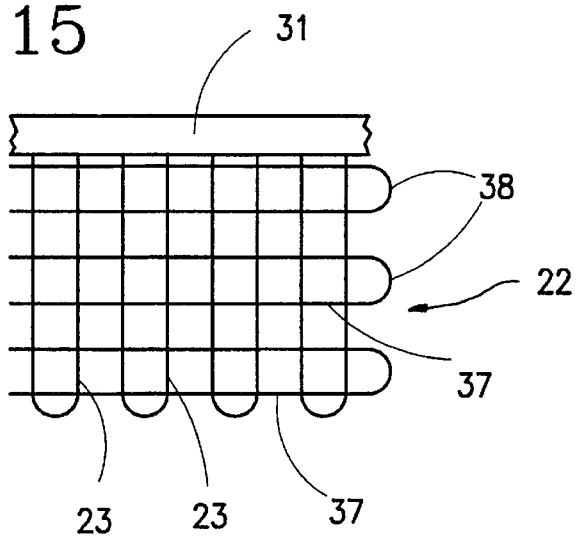
FIG. 15 shows a schematic of loop filaments of a sealing member which are provided with transverse filaments, the loop filaments being cut into sections.

FIG. 15 shows an embodiment which corresponds to that of FIG. 9 with the difference that the individual loops 23 are crosslinked to one another by means of separate transverse filaments 37. The transverse filaments 37 can, likewise, be formed as loops 38.

Figure 16:
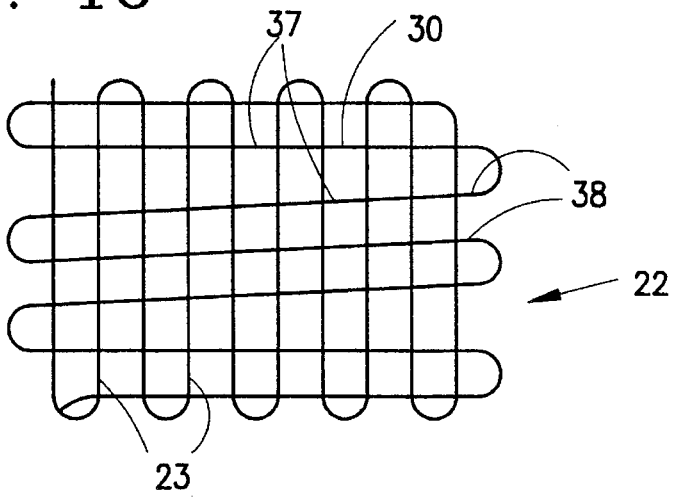
FIG. 16 shows an embodiment according to FIG. 15, but with an endless filament.

While in the embodiment of FIG. 15 cut-off filaments 34 are used, in the embodiment of FIG. 16, a continuous filament 30 is used which forms both the loops 23 and the linking loops 38. Due to transverse filaments 37 reinforcement of the crosslinking of loops 23 is engendered.

Figure 17:
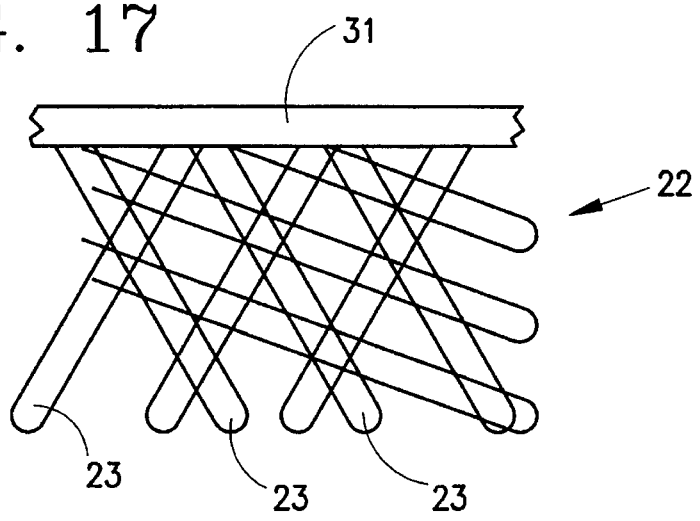
FIG. 17 shows an embodiment according to FIG. 10, but with transverse filaments.

FIG. 17 shows an embodiment in which loops 23 run at acute or obtuse angles to the longitudinal extension of mount 31 and in which transverse filaments 37 are not parallel to the longitudinal extension of holder 31, as is the case in the embodiments of FIGS. 15 and 16. Instead, the transverse filaments 37 run at an angle, i.e., diagonally, to the longitudinal extension of holder 31, and thus, diagonally to the longitudinal extension of ventilator cover 2. It is also possible to form different angles, for which an angular offset can be periodically provided or is randomly stipulated.

FIG. 18, again, illustrates an arrangement based upon the FIG. 3 embodiment, in which, however, the packing density of the individual loops 23 is illustrated, i.e., individual loops 23 which lie adjacent to one another fit into one another and thus crosslink to form an integral structure.

Figure 18:
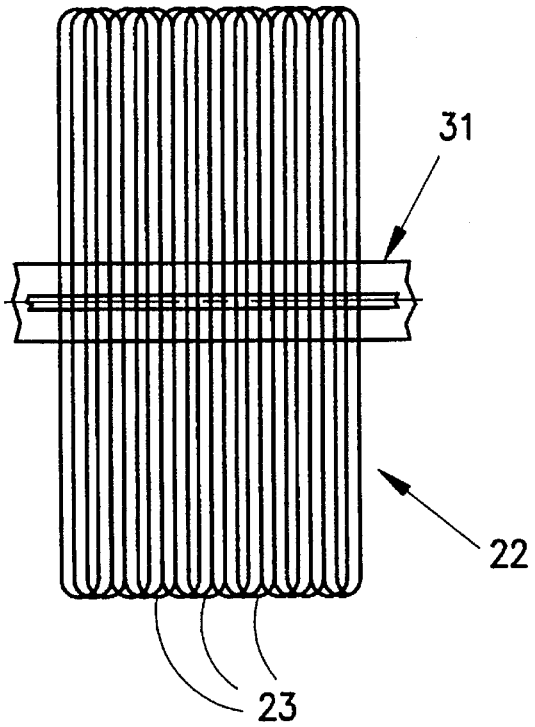
FIG. 18 shows a sealing member with loops of uniform loop length in an intermediate stage of being mounted.
Figure 19:
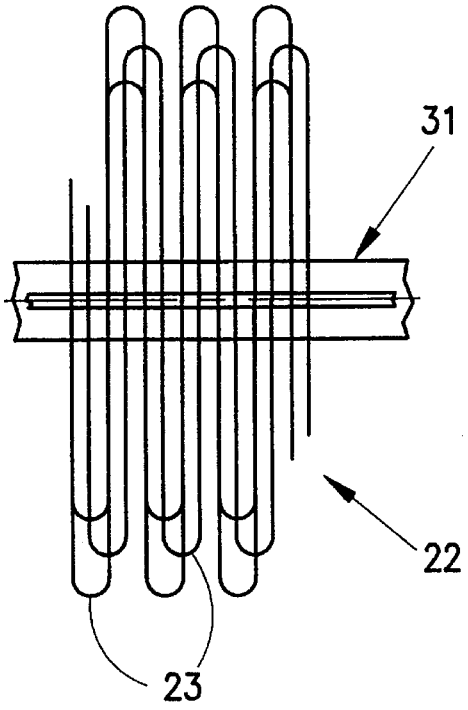
FIG. 19 shows a sealing member corresponding to the embodiment of FIG. 18, however with different loop length.

The embodiment of FIG. 19 differs from that of FIG. 18 in that the loops 23 used have loop lengths of different size, by which a stepped or wedge-shaped path of the profile of loop filament seal 22 is established.

Figure 20:
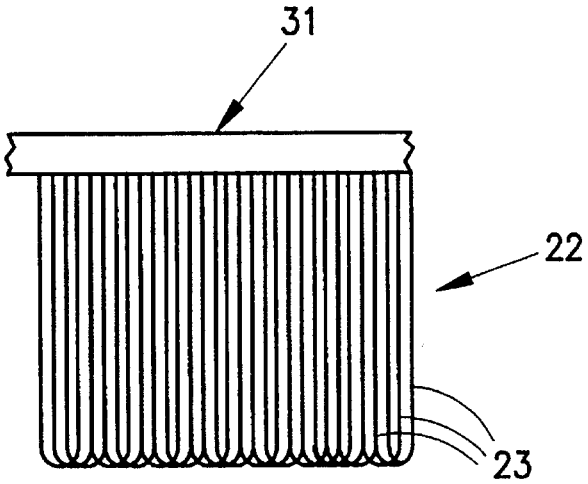
FIG. 20 shows the embodiment of FIG. 18 in the mounted state.

FIG. 20 shows the sealing member of FIG. 18 in the finished state. That is, after folding over of the clamping sheet 32.

Figure 21:
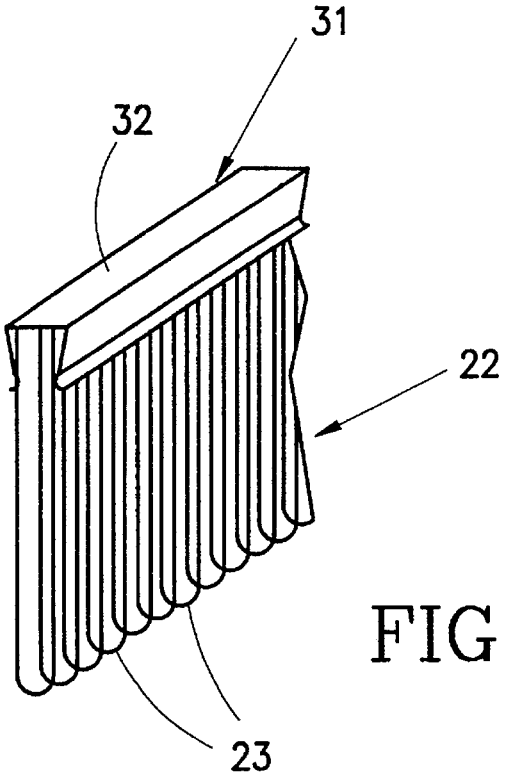
FIG. 21 shows a perspective representation of a sealing member according to the invention.

To illustrate the dimension of thickness of loop filament seal 22, FIG. 21 shows a perspective representation. It can be clearly seen that clamping sheet 32 has a U-shaped profile when folded. The individual loops 23 lie next to one another, within one another, and on top of one another in an closely packed arrangement.

Figure 22:
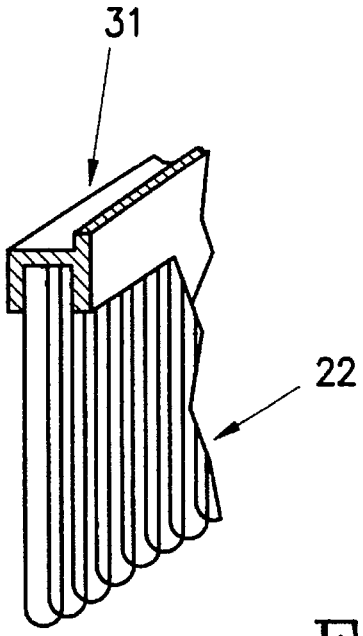
FIG. 22 shows a perspective representation of the sealing member according to another embodiment.

FIG. 22 shows another embodiment in which holder 31 is formed not as a clamping sheet 32, but as a plastic part which is used for attachment of individual loops 23, and in which loops 23 can be attached by cementing or bonding.

Figure 23:
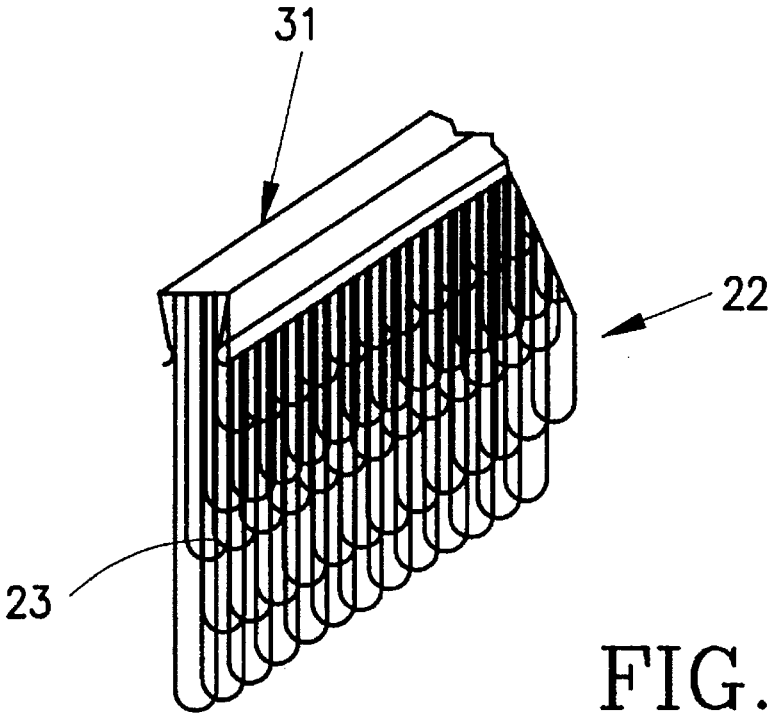
FIG. 23 shows a perspective representation of a sealing member with different lengths of the loop such that a wedge-shaped profile is formed.

FIG. 23 shows loop filament seal 22 formed in a wedge-shaped profile which is formed by correspondingly placing long loops 23 on top of one another such that the smallest packing density is established on the end of loops 23 and the largest packing density is established in the area of holder 31.

Figure 24:
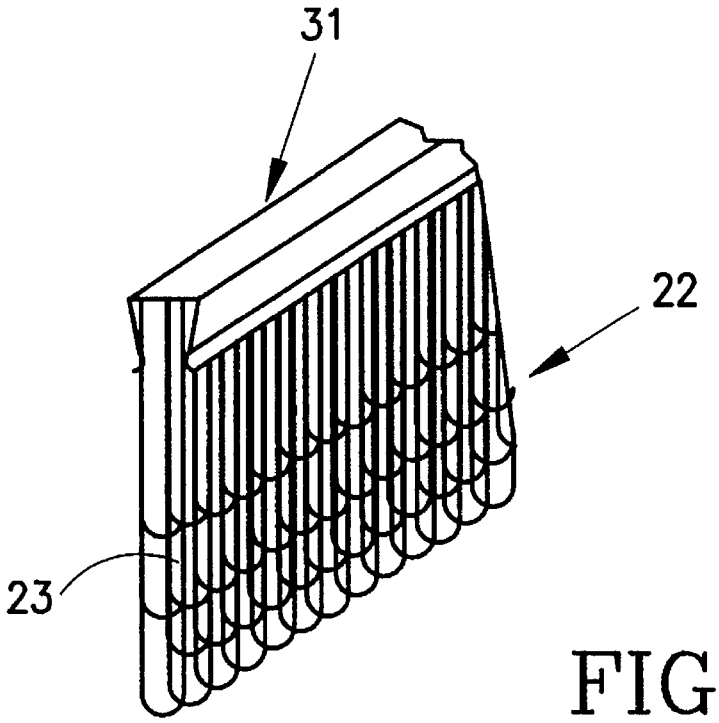
FIG. 24 shows another embodiment of a sealing member provided with loops of different length, by which a stepped profile is formed.
Figure 25:
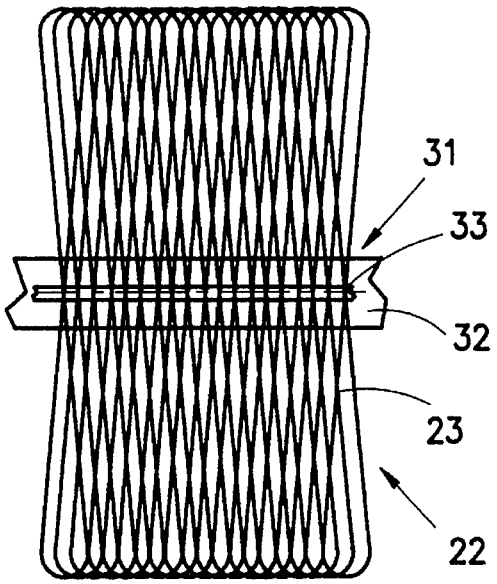
FIG. 25 shows an embodiment of a sealing member with loops which run diagonally in an intermediate stage of being mounted.

The embodiment of FIG. 24 differs by loops 23 being arranged such that they yield a step-shaped profile of loop filament seal 22. To form an arrangement which corresponds roughly to that of FIG. 8, loops 23 are placed as shown in FIG. 25. They have the configuration of a large multiple figure eight, holder 31 being located in the area of the crossing points of the figure eight.

Figure 26:
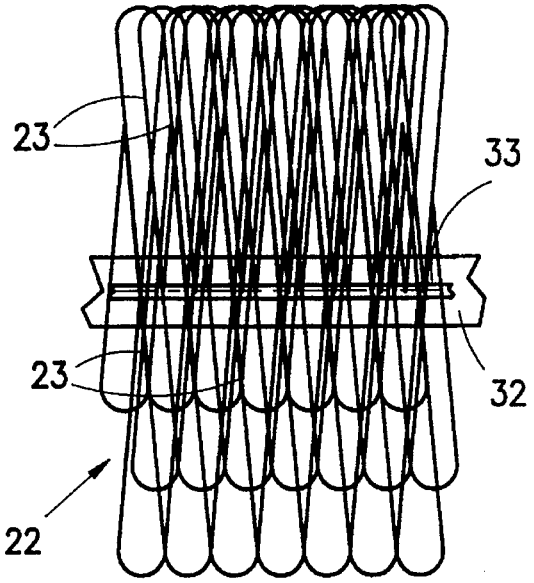
FIG. 26 shows a diagonal loop embodiment as in FIG. 25, however, with loops of different length on one side.

The embodiment according to FIG. 26 corresponds approximately to the embodiment of FIG. 25, however the loop lengths being different only on one side of the not yet folded-over loop arrangement; on the other side are loops 23 of equal length. It is also possible to proceed such that the individual loops 23 are laid down in a multiple FIG. 8.

Figure 27:
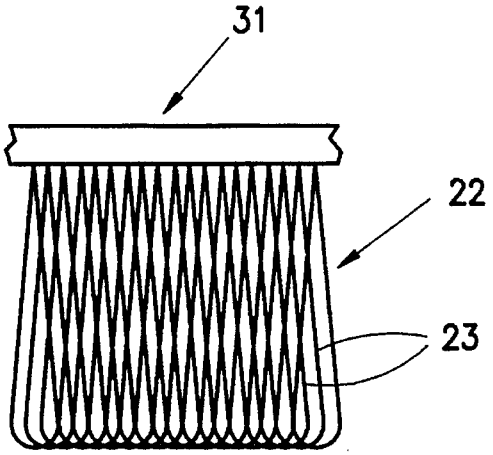
FIG. 27 shows the embodiment of FIG. 25 in the mounted state.

FIG. 27 shows the embodiment according to FIG. 25 in the finished state.

Figure 28:
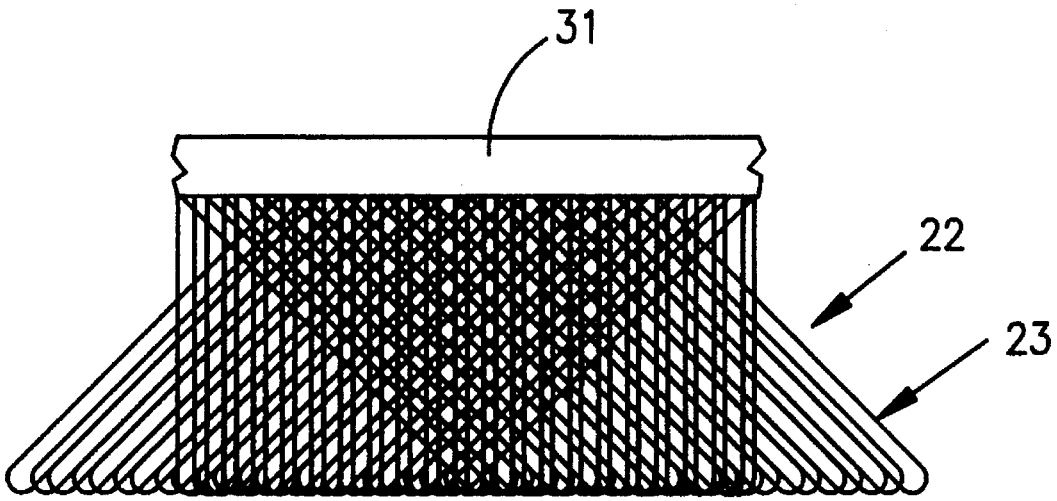
FIG. 28 shows an embodiment of a sealing member with loops which run in an extreme diagonal position.

FIG. 28 shows an embodiment of the loop filament seal 22 according to the invention in which individual loops 23 assume an extreme angular position relative to the longitudinal extension of holder 31, by which manifold overlapping and interlinking appear.

Figure 29:
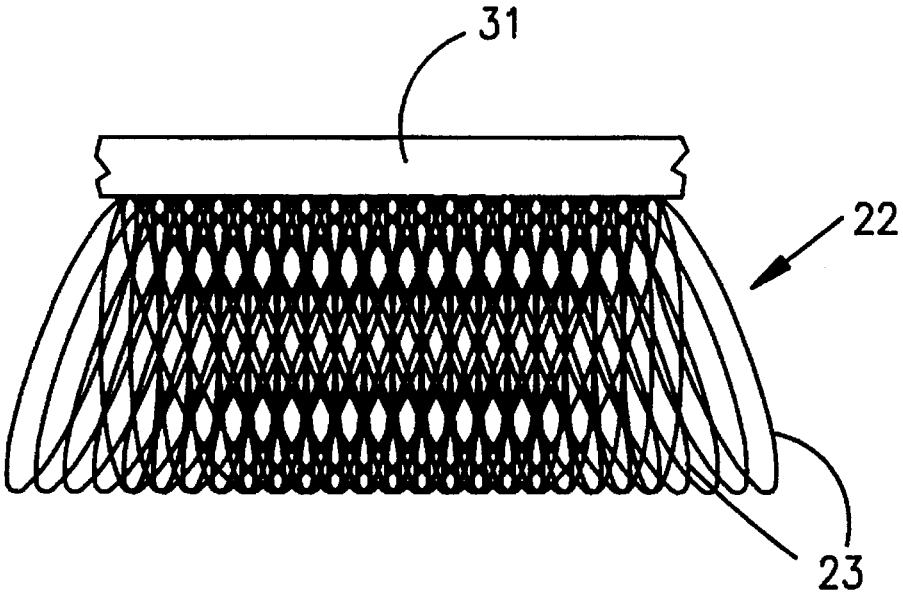
FIG. 29 shows a sealing member in which the loops assume a tangled position, and therefore, are mostly randomly oriented.

FIG. 29 shows an embodiment of the loop filament seal 22 according to the invention in which individual loops 23 assume a random orientation to one another, i.e., a type of felt effect is achieved, by which extreme coupling of individual loops 23 is present.

Figure 30:
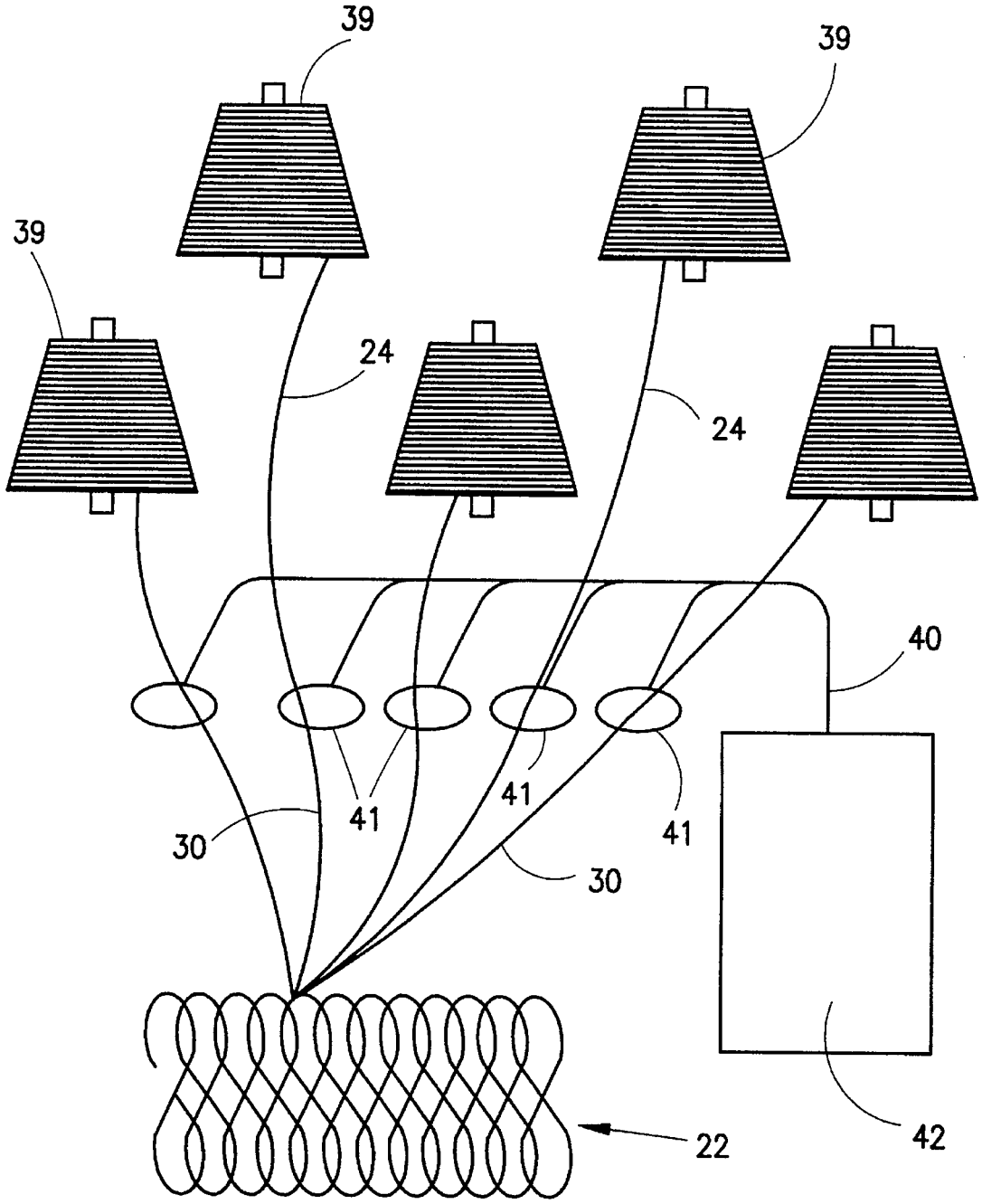
FIG. 30 shows a device for preparing a sealing member according to the invention.

Finally, FIG. 30 illustrates one possible production process for loop arrangements of loop filament seal 22 according to the invention. Preferably, a plurality of dispenser rolls 39 are provided on which filament material 24 is wound as continuous filaments 30. By means of a filament layering apparatus 40 which has eyes 41 according to the number of continuous fibers 30, and through which continuous filaments 30 run, loops are formed, in which at the same time several loops 23 can be layered. This is done by moving filament layering apparatus 40 accordingly by means of device 42, which is neither shown nor described in detailed, since the construction of such apparatus, itself, forms no part of this invention. Likewise, the device which draws off continuous filaments 30 in the layering process is not shown for reasons of simplification.

I claim:

1. Ventilating element for roofs, with a ventilator cover in one of a ridge, hip and arris area, at least one elastically flexible sealing member being disposed along a longitudinal edge thereof, wherein the sealing member is formed of loop filament seal having a multiplicity of filament loops, and wherein at least some of the loops are interconnected by means of transverse filaments.

2. Ventilating element according to claim 1, wherein said transverse filaments run essentially parallel to a direction of longitudinal extension of ventilator cover.

3. Ventilating element according to claim 2, wherein the loops are formed by continuous filaments.

4. Ventilating element according to claim 3, wherein the loops and transverse filaments are formed from the same continuous filaments.

5. Ventilating element according to claim 1, wherein the filament loops are free of supporting structure in a sealing area thereof.

6. Ventilating element according to claim 1, wherein the flexible sealing member remains stationary with respect to a sealing surface.

7. Ventilating element for ventilating of ridge, hip and arris areas of a roof, comprising a cover member having a central fastening portion intermediate and interconnecting a pair of side wall portions, each side wall portion having an elastically flexible sealing member being disposed along a longitudinal edge thereof; wherein the sealing member is comprises a loop filament seal having a multiplicity of filament loops arranged to produce an essentially flow-tight packing density; wherein rows of loops are arranged in layers which are held together at an end of the layers by a holder, the holder and each layer extending along the longitudinal edge; and wherein the loops are in a folded over form, the holder holding rows of folded over loops at a fold thereof.

8. Ventilating element according to claim 7, wherein portions of the loops on one side of the fold are of a different length than portions of the loops at an opposite side of the fold.

* * * * *